US005327404A

United States Patent [19]

Nolan

[11] Patent Number: 5,327,404

[45] Date of Patent: Jul. 5, 1994

[54] ON-CHIP FREQUENCY TRIMMING METHOD FOR REAL-TIME CLOCK

[75] Inventor: James B. Nolan, Phoenix, Ariz.

[73] Assignee: VLSI Technology, Inc., San Jose, Calif.

[21] Appl. No.: 619,146

[22] Filed: Nov. 27, 1990

[51] Int. Cl.[5] ..... G04B 18/00

[52] U.S. Cl. ..... 368/201

[58] Field of Search ..... 368/155-157, 368/200-202; 331/116, 176

[56] References Cited

U.S. PATENT DOCUMENTS

| | | | |
|---|---|---|---|
| 4,043,109 | 8/1977 | Numabe | 369/201 |
| 4,101,238 | 2/1978 | Aihara et al. | 368/200 |
| 4,154,053 | 5/1979 | Chetelat et al. | 368/200 |
| 4,300,224 | 11/1981 | Nakazaki et al. | 368/201 |
| 4,408,897 | 10/1983 | Mutrux | 368/200 |
| 4,464,061 | 8/1984 | Kamiya | 368/202 |
| 4,763,309 | 8/1988 | Descombes | 368/201 |

*Primary Examiner*—Vit W. Miska

*Attorney, Agent, or Firm*—Harry M. Weiss & Associates

[57] ABSTRACT

Apparatus for digitally trimming the output frequency of a real-time clock is disclosed. The output frequency of a divider chain is adjusted by the contents of a trim constant register. The amount of correction and direction (slow or fast) to be effected is determined by the trim constant register. During "slow" real-time clock operation, the divider chain "shortens" the next second produced by the real-time clock. During "fast" real-time clock operation, the production of the next second is blocked and then a portion of the "blocked" signal is "added back" to effectively "lengthen" the next second produced by the real-time clock.

18 Claims, 4 Drawing Sheets

ON-CHIP FREQUENCY TRIMMING METHOD FOR REAL-TIME CLOCK

TECHNICAL FIELD

The present invention relates, in general, to apparatus for adjusting the frequency of a real-time clock and, more particularly, to apparatus for digitally trimming the frequency of such a clock.

BACKGROUND ART

Frequency adjustment (trimming) is typically accomplished by a crystal oscillator circuit which usually consists of a crystal, resistance-capacitance feedback circuit, and an on-chip amplifier. Due to significant variations in the crystal resonant frequency and component tolerances, some form of frequency adjustment is usually required to achieve the level of accuracy required in many real-time clock applications. For example, a crystal may have a frequency tolerance of 20 ppm (parts per million) which, at 32.768 Khz, can result in a time deviation of about 2 seconds per day. In some earlier real-time clock designs, frequency trimming has been achieved by varying one or more trimming capacitors during the final board assembly and testing procedure. This method of trimming has several inherent disadvantages, for example, the trimming capacitor must be easily accessible for adjustment, a variable capacitor is significantly larger than a fixed capacitor having the same capacitance value, and capacitor trimming prohibits integrating the capacitor on-chip. In addition, typically after the trimming operation has been completed, the variable capacitor is usually covered with epoxy so that inadvertent capacitance changes do not occur. This approach not only reduces reliability, but also makes future adjustment of the trimming capacitor much more difficult.

Because of the foregoing disadvantages associated with prior art frequency trimming apparatus and methods, it has become desirable to develop apparatus for digitally trimming the frequency of a real-time clock.

SUMMARY OF THE INVENTION

The present invention solves the problems associated with the prior art by providing apparatus for digitally trimming the frequency of a real-time clock. The amount of correction and direction (slow or fast) to be effected to a 13 thirteenstage divider chain is determined by the contents of the trim constant register which is preset during board checkout. During "slow" real-time clock operation, the "timing-out" of an adjustment timer every 64 seconds causes tile contents of the trim constant register to set and/or clear appropriate flip-flops in the divider chain to generate a "short" second. During "fast" real-time clock operation, the production of a 1 second pulse is actually blocked and then a portion of this "blocked" pulse is "added back" so as to effectively produce a "long second". In this manner, precise control of the real-time clock can be achieved.

DESCRIPTION OF THE PREFERRED EMBODIMENT

In accordance with one embodiment of this invention, an apparatus for adjusting the frequency of a device is disclosed comprising, trim constant register means for storing an amount and a direction of correction to be affected to the frequency of a real-time clock, divider interface means coupled to an output of the trim constant register means for providing an output signal dependent upon the output of the trim constant register means, means for dividing the frequency of an incoming signal to the apparatus coupled to the output signal of the divider interface means, timer means responsive to a signal produced by the dividing means, and means coupled to the divider interface means for establishing the amount of change required in the output frequency of the dividing means, wherein the establishing means is actuated by the timer means and the output signal of the divider interface means varies the output frequency of the dividing means in response to an amount of change set by the establishing means.

In accordance with another embodiment of this invention, a method of adjusting the frequency of a device is provided comprising the steps of, providing trim constant register means for storing an amount and a direction of correction to be affected to the frequency of a real-time clock, providing divider interface means coupled to an output of the trim constant register means for providing an output signal dependent upon the output of the trim constant register means, providing means for dividing the frequency of an incoming signal that is provided to an electronic apparatus coupled to the output signal of the divider interface means, providing timer means responsive to a signal produced by the dividing means, and providing means coupled to the divider interface means for establishing the amount of change required in the output frequency of the dividing means, wherein the establishing means is actuated by the timer means and the output signal of the divider interface means varies the output frequency of the dividing means in response to an amount of change set by the establishing means.

Figure 1:
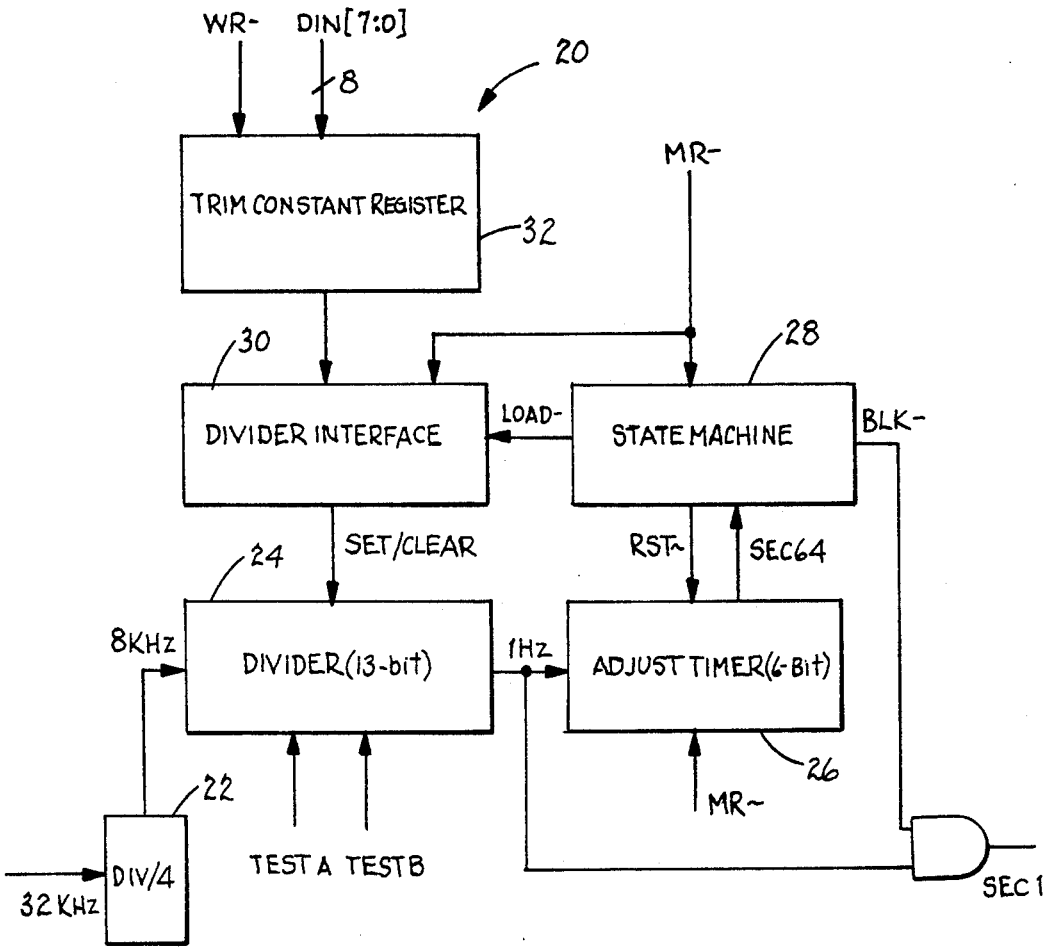
FIG. 1 is a schematic block diagram of the digital trimming circuit of the present invention.

Referring now to the drawings where the illustrations are for the purpose of describing the preferred embodiment of the present invention and are not intended to limit the invention described herein, FIG. 1 is a schematic block diagram of the digital trimming circuit 20 of the present invention. The digital trimming circuit 20 is comprised of digital dividers 22 and 24, an adjustment timer 26, an adjustment state machine 28, a divider interface 30, and a trim constant register 32. All of the foregoing elements are provided on an integrated circuit chip, thus no external trimming components are requried, leaving only the crystal to be attached externally to the real-time clock. The amount of correction and direction (slow or fast) to be affected to the real-time clock is contained in the trim constant register 32 and is preset durign board checkout. Alternatively, the trim constant register 32 can be driven by a multiplexing unit which monitors temperature, voltage and/or other environmental conditions to provide increased accuracy over a broad operating range.

Figure 3:
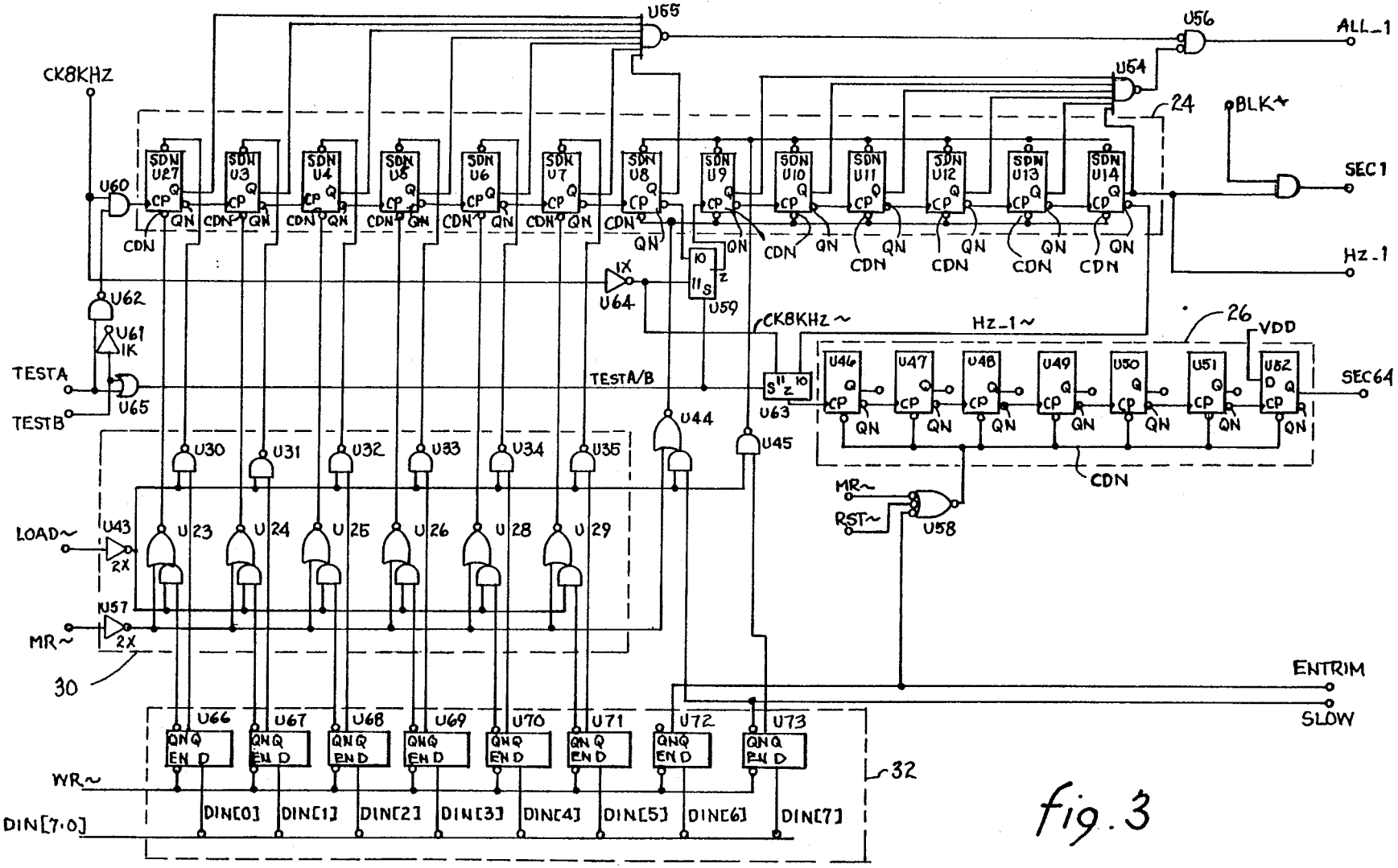
FIG. 3 is a detailed logic circuit diagram of the digital divider, the adjustment timer, the divider interface and the trim constant register of the present invention.
Figure 4:
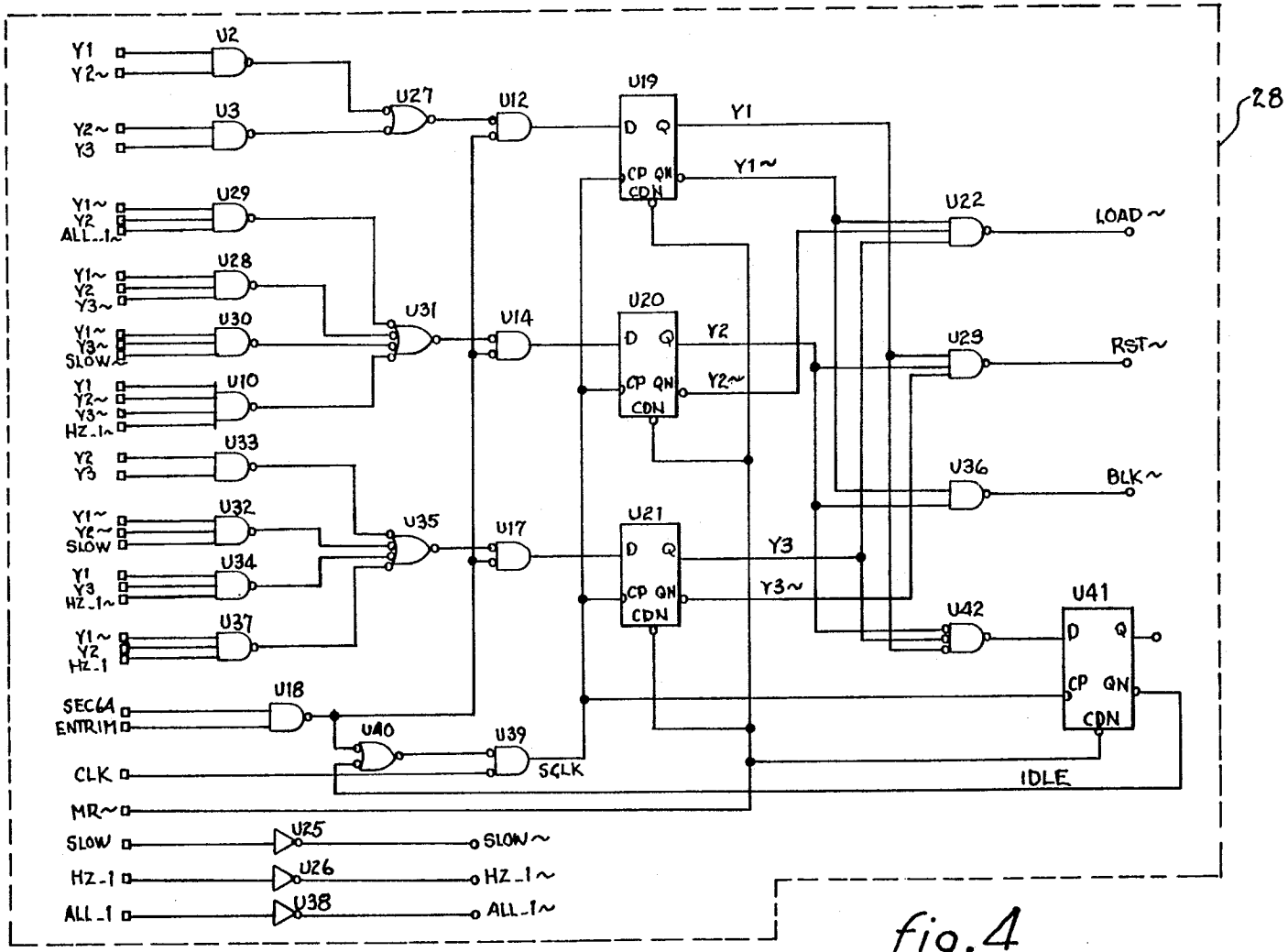
FIG. 4 is a detailed logic circuit diagram of the state machine of the present invention.

Under normal operating conditions, the division function is provided by divider 22 and thirteen-stage divider 24 in order to reduce the 32.768 Khz input frequency down to 1 hz. The output of the divider 24 drives the adjustment timer 26 and the internal timer circuit for the real-time clock which maintains the correct time. The adjustment timer 26 is a six-bit timer which "times-out" every 64 seconds. When timer 26 "times-out", the state machine 28 is activated changing the output frequency of the divider 24 resulting in the generation of a "long second" if the real-time clock is running fast or a "short second" if the real-time clock is running slow. The amount of time in which the next second of the real-time clock is lengthened or shortened is determined by the contents of the trim constant register 32. Once a time adjustment has been completed, operation of the real-time clock reverts back to its normal operating mode until the adjustment timer 26 "times-out" again, i.e., 64 seconds. A detailed logic circuit diagram of the divider 24, adjustment timer 26, trim constant register 32 and a divider interface 30 that is interposed between the trim constant register 32 and the divider 34 is illustrated in FIG. 3, and a detailed logic circuit diagram of the state machine 28 is shown in FIG. 4.

Figure 2:
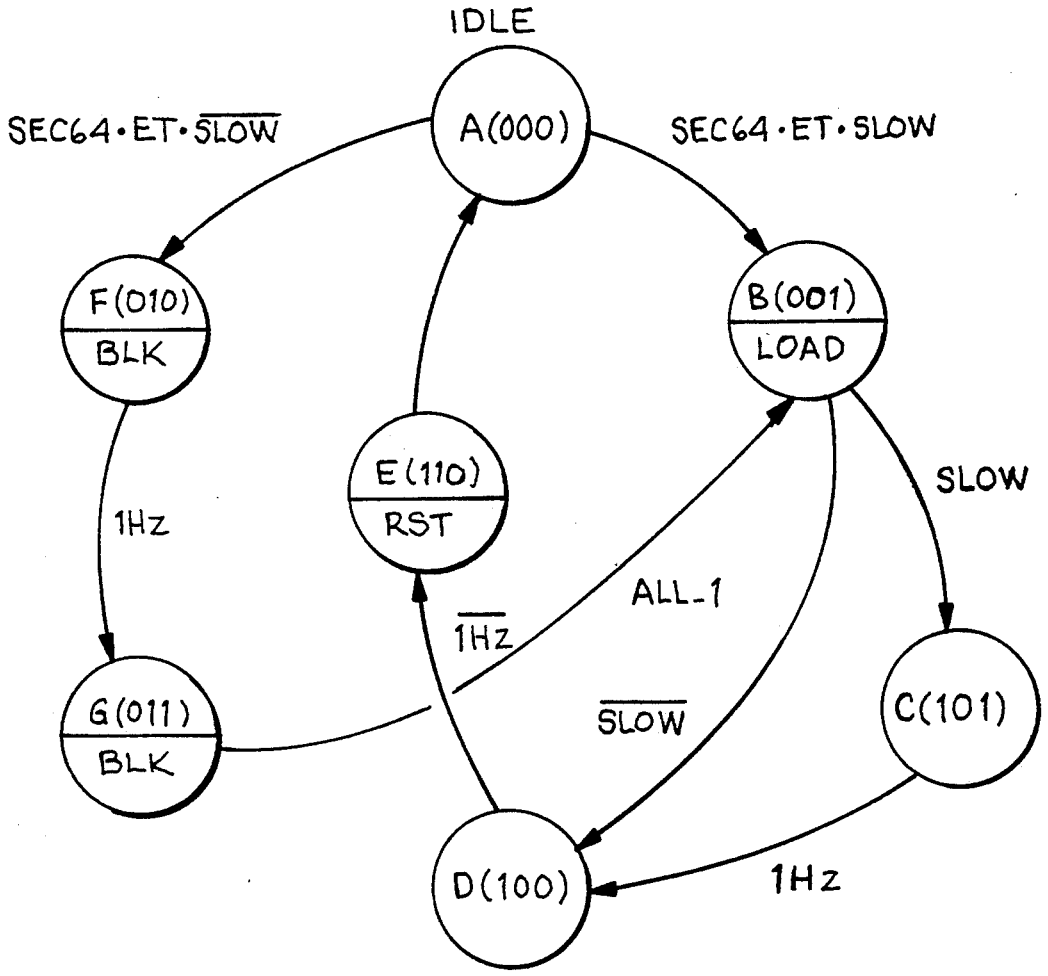
FIG. 2 is a diagram of the frequency adjustment states of the present invention.

Referring to FIG. 2, a diagram frequency adjustment states is illustrated. Starting in state A (the idle state), if the real-time clock is running slow, upon the next "timing-out" of adjustment timer 26, the adjustment state machine 28 is activated causing the system to go from state A to state B. In state B (the load state), the state machine 28 causes the information in the trim constant register 32 for "slow" real-time clock operation to be transferred to the divider interface 30 to set and/or clear the appropriate flip-flops inside the divider 24 in order to correct for "slow" operation of the clock. In this state, the trimming constant is loaded into the lower six bits of divider 24 and the upper seven bits of this divider are cleared to zero causing the output frequency of the divider to change resulting in the generation of a "short" second. Upon the next clock signal, the system proceeds to state C which is an intermediate synchronization state. Upon successive clock signals, the system proceeds to state D and to state E, which is a reset state wherein the adjustment timer 26 and divider 24 are reset. Upon the expiration of still another clock signal, the system reverts back to state A (the idle state), and the state machine 28 is turned "off" to conserve power.

When the real-time clock is running "fast" the "timing out" of adjustment timer 26 causes the state machine 28 to proceed from state A (the idle state) to state F in which a block (BLK) signal is produced and transmitted to an output gate. The duration of this block (BLK) signal is one second. The next two clock signals cause the system to proceed from state F through state G to state B, wherein the state machine 28 causes the information in trim constant register 32 for "fast" real-time clock operation to be transferred to the divider interface 30 to set and/or clear the appropriate flipflops in the divider 24 to correct for "fast" operation of the clock. In state B, the trimming constant is loaded into the lower six bits of divider 24 and the upper seven bits of this divider are set to one causing the output frequency of the divider to change resulting in the production of a "short" second. Upon successive clock signals, the system proceeds to state D and state E which is the reset state wherein the adjustment timer 26 and the divider 24 are reset. Lastly, upon the expiration of still another clock signal, the system proceeds from state E to state A (the idle state) and the state machine 28 is turned "off" to conserve power. In essence, when the real-time clock is running "fast", the state machine 28 blocks one second during state F and then adds a portion of the "blocked" second when the system produces a "short" second so that precise control of the real-time clock can be achieved. Thus, only a small portion of a second, rather than a whole second, is lost during correction for "fast" operation of the real-time clock.

In the "slow" clock mode of operation, the minimum trimming resolution using the present invention is approximately 0.125 msec/64 sec or 2 ppm. This corresponds to 0.066 hz at 32.768 Khz or about 5 seconds per month. A maximum adjustment of 7.88 msec/64 sec or 123 ppm is possible with the present invention. This corresponds to just over 4.0 hz at 32.768 Khz. For a minimum adjustment, a trimming constant of all zeros is used, and all ones are used for maximum adjustment. In a "fast" clock mode of operation, the resolution and maximum adjustment values are approximately the same. However, for minimum adjustment in this latter mode of operation, a trimming constant of all ones is used and all zeros are used for a maximum adjustment.

The minimum resolution can be improved by adding more delay between the "time-out" of the adjustment timer, however, this approach reduces the amount of maximum compensation possible. The maximum compensation amount can be increased by setting and/or clearing more bits of the divider 24 via the trim constant register 32. Additional logic can be easily added to implement the foregoing changes. For example, the enable bit in the trim constant register can be replaced by a fine-tune bit and the "time-out" of the adjustment timer can be increased from 64 seconds to 128 seconds by inserting another stage in the adjustment timer chain.

It should be noted that the foregoing discussion of the present invention is directed to a 32 Khz real-time clock application, however, the present invention can be easily extended to other frequencies or any other application where frequency accuracy is necessary. This can be accomplished by changing the number of divider and/or adjustment timer stages, as well as the number of bits in the trim constant register.

Certain modifications and improvements will occur to those skilled in the art upon reading the foregoing. It should be understood that all such modifications and improvements have been deleted herein for the sake of conciseness and readability, but are properly with the scope of the following claims.

I claim:

1. Apparatus for adjusting the frequency of a device comprising:

trim constant register means for storing an amount and a direction of correction to be affected to the frequency of a real-time clock;

divider interface means directly connected to an output of said trim constant register means for providing an output signal dependent upon the output of said trim constant register means;

means for dividing the frequency of an incoming signal to the apparatus coupled to the output signal of said divider interface means, said dividing means being separated from said trim constant register means by said divider interface means;

timer means responsive to a signal produced by said dividing means; and state machine means coupled to said divider interface means for executing at least one of a first sequence of states for applying a signal representation of a stored amount of correction designating a slow correction from said trim constant register means to said divider interface means in a first manner that slows said frequency of said real-time clock in response to application of said direction of correction from said trim constant register means to said state machine means and a second sequence of states for applying a signal representation of a stored amount of correction designating a fast correction from said trim constant register means to said divider interface means in a second manner that accelerates said frequency of said real-time clock in response to application of said direction of correction from said trim constant register means to said state machine means, said state machine means being actuated by a direct connection with said timer means, said output signal of said divider interface means varying the output frequency of said dividing means in response to said application of said stored amount of correction in at least one of said first manner and said second manner.

2. The apparatus as defined in claim 1 wherein said state machine is actuated upon the "timing-out" of said timer means.

3. The apparatus as defined in claim 2 wherein said timer means is actuated after a pre-determined period of time.

4. The apparatus as defined in claim 1 wherein said state machine means implements the amount of change required in the output frequency of said dividing means and the direction of change to be applied to the output frequency of said dividing means when said direction increases said output frequency.

5. The apparatus as defined in claim 1 wherein said state machine means implements the amount of change required in the output frequency of said dividing means and the direction of change to be applied to the output frequency of said dividing means when said direction decreases said output frequency.

6. The apparatus as defined in claim 1 wherein said trim constant register means includes means permitting the adjustment of the amount of change and the direction of change required in the output frequency of said dividing means.

7. The apparatus as defined in claim 1 wherein said dividing means includes a plurality of divider stages, the number of said divider stages being variable permitting the output frequency of said dividing means to be varied.

8. The apparatus as defined in claim 1 wherein an output signal from the apparatus is blocked for a first pre-determined period of time when the apparatus is in a first mode of operation.

9. The apparatus as defined in claim 8 wherein the duration of said blocked signal is decreased by a second pre-determined period of time when the apparatus is in said first mode of operation.

10. A method for adjusting the frequency of a device comprising the steps of:

providing trim constant register means for storing an amount and a direction of correction to be affected to the frequency of a real-time clock;

providing divider interface means directly connected to an output of said trim constant register means for providing an output signal dependent upon the output of said trim constant register means;

providing means for dividing the frequency of an incoming signal that is provided to an electronic apparatus coupled to the output signal of said divider interface means, said dividing means being separated from said trim constant register means by said divider interface means;

providing timer means responsive to a signal produced by said dividing means; and providing state machine means coupled to said divider interface means for executing at least one of a first sequence of states for applying a signal representation of a stored amount of correction designating a slow correction from said trim constant register means to said divider interface means in a first manner that slows said frequency of said real-time clock in response to application of said direction of correction from said trim constant register means to said state machine means and a second sequence of states of applying a signal representation of a stored amount of correction designating a fast correction from said trim constant register means to said divider interface means in a second manner that accelerates said frequency of said real-time clock in response to application of said direction of correction from said trim constant register means to said state machine means, said state machine means being actuated by a direct connection with said timer means, said output signal of said divider interface means varying the output frequency of said dividing means in response to said application of said stored amount of correction in at least one of said first manner and said second manner.

11. The method as defined in claim 10 wherein said state machine is actuated upon the "timing-out" of said timer means.

12. The method as defined in claim 11 wherein said timer means is actuated after a pre-determined period of time.

13. The method as defined in claim 10 wherein said state machine means implements the amount of change required in the output frequency of said dividing means and the direction of change to be applied to the output frequency of said dividing means when said direction increases said output frequency.

14. The method as defined in claim 10 wherein said state machine means implements the amount of change required in the output frequency of said dividing means and the direction of change to be applied to the output frequency of said dividing means when said direction decrease said output frequency.

15. The method as defined in claim 10 wherein said trim constant register means includes means permitting the adjustment of the amount of change and the direction of change required in the output frequency of said dividing means.

16. The method as defined in claim 10 wherein said dividing means includes a plurality of divider stages, the number of said divider stages being variable permitting the output frequency of said dividing means to be varied.

17. The method as defined in claim 10 wherein an output signal from the apparatus is blocked for a first pre-determined period of time when the apparatus is in a first mode of operation.

18. The method as defined in claim 17 wherein an duration of said blocked signal is decreased by a second pre-determined period of time when the apparatus is in said first mode of operation.

* * * * *